US007744340B2

(12) United States Patent
Levin et al.

(10) Patent No.: US 7,744,340 B2
(45) Date of Patent: Jun. 29, 2010

(54) LINEAR FAN

(76) Inventors: Yefim Levin, 100 Norway St., #215, Boston, MA (US) 02115; Vadim Levin, 80 Boulder Rd., Newton, MA (US) 02459

( * ) Notice: Subject to any disclaimer, the term of this patent is extended or adjusted under 35 U.S.C. 154(b) by 1072 days.

(21) Appl. No.: 11/818,961

(22) Filed: Apr. 25, 2006

(65) Prior Publication Data

US 2009/0028689 A1 Jan. 29, 2009

(51) Int. Cl.
*F03B 9/00* (2006.01)

(52) U.S. Cl. ..... 415/5

(58) Field of Classification Search ..... 415/5
See application file for complete search history.

(56) References Cited

U.S. PATENT DOCUMENTS

| | | | | |
|---|---|---|---|---|
| 1,305,727 | A * | 6/1919 | Linnd | 416/8 |
| 3,270,805 | A * | 9/1966 | Glucksman | 165/122 |
| 4,292,535 | A * | 9/1981 | Diggs | 290/54 |
| 4,350,474 | A * | 9/1982 | Murphy | 416/7 |
| 6,435,827 | B1 * | 8/2002 | Steiner | 416/8 |

* cited by examiner

*Primary Examiner*—Edward Look
*Assistant Examiner*—Jesse Prager

(57) ABSTRACT

The linear fan comprises blades that are fixed onto a flexible transmission engaging leading and follower pulleys. Each blade has cylindrical shanks to facilitate swivel fixation. The veer of the blades is provided with directive disks.

1 Claim, 2 Drawing Sheets

LINEAR FAN

SUMMARY OF THE INVENTION

An object of the invention is to provide large volume of the air with a relatively compact installation of a fan.

This object is accomplished by providing a linear fan comprised of blades fixed on two flexible transmissions. This fixation is swivel. The fan has system of disks and arms that provides changing position of the blades with respect to the belts.

The described fan can also be used as a blower.

BACKGROUND OF THE INVENTION

The presented linear fan belongs to category of industrial fans and blowers. The known implementations of a linear fan usually have smaller transversal sizes than ordinary fans. The blades of such fans are placed on flexible endless transmission. Herewith the blades of one branch of the transmission interact with air in a manner not coordinated with blades on the other branch of the transmission. So, the known implementations of linear fan, in some cases, have mechanisms for a cyclical veer of the blades, in other cases, this shortcoming is ignored. In any case, power losses due to the inherent design characteristics of linear fans can be substantial. The goal of the presented invention is to reduce the losses.

DETAILED DESCRIPTION OF THE INVENTION

The presented invention will be described by way of example with reference to accompanying drawings listed above.

Figures 1, 2, 2A:
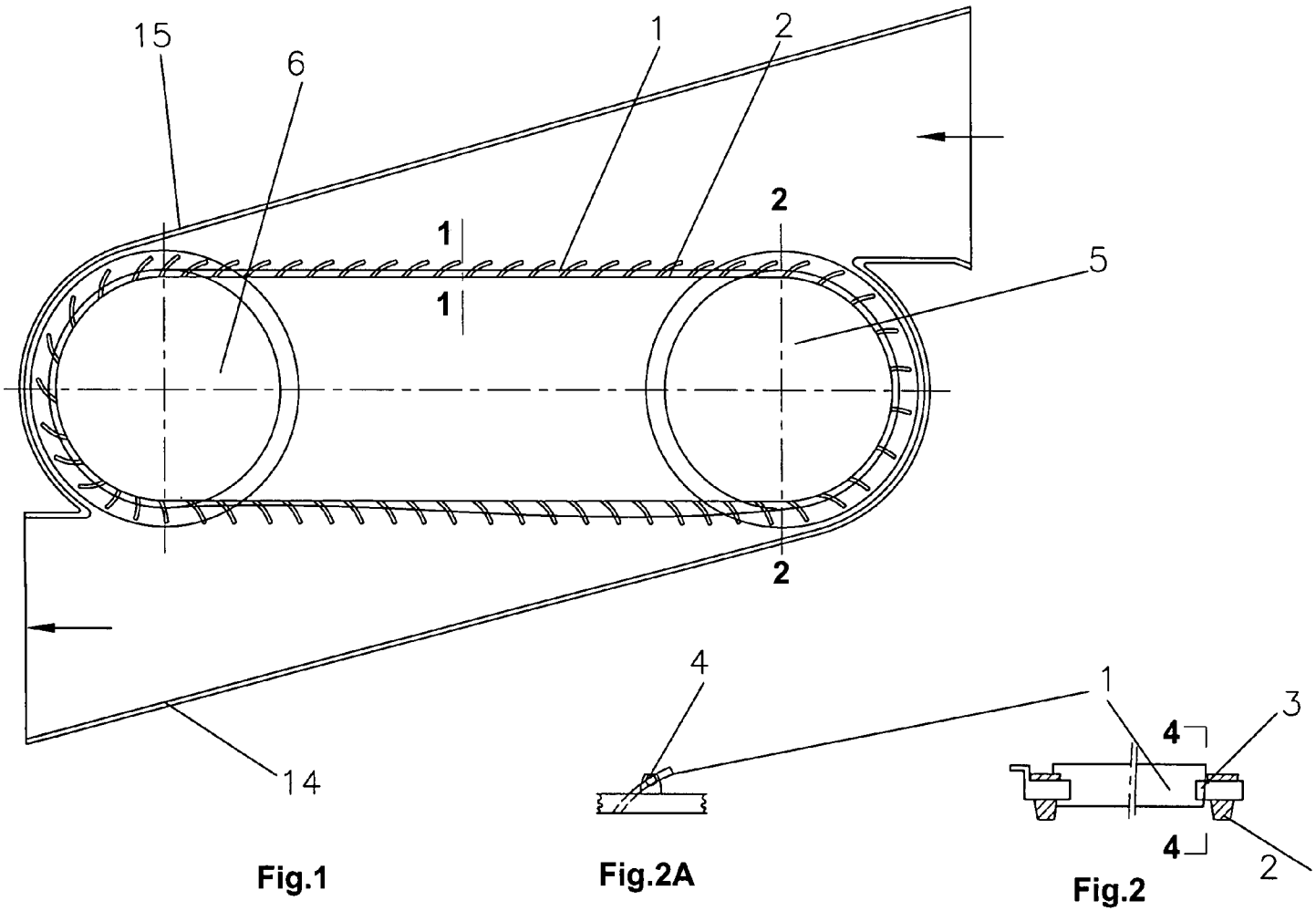
FIG. 1 is a schematic view of the fan according to the invention.
FIG. 2 illustrates a local section of the fan shown in FIG. 1 and indicated with 1-1 in FIG. 1.
FIG. 2A illustrates a local section of the belt and blade shown in FIG. 2 and indicated with 4-4 in FIG. 2.
Figure 3:
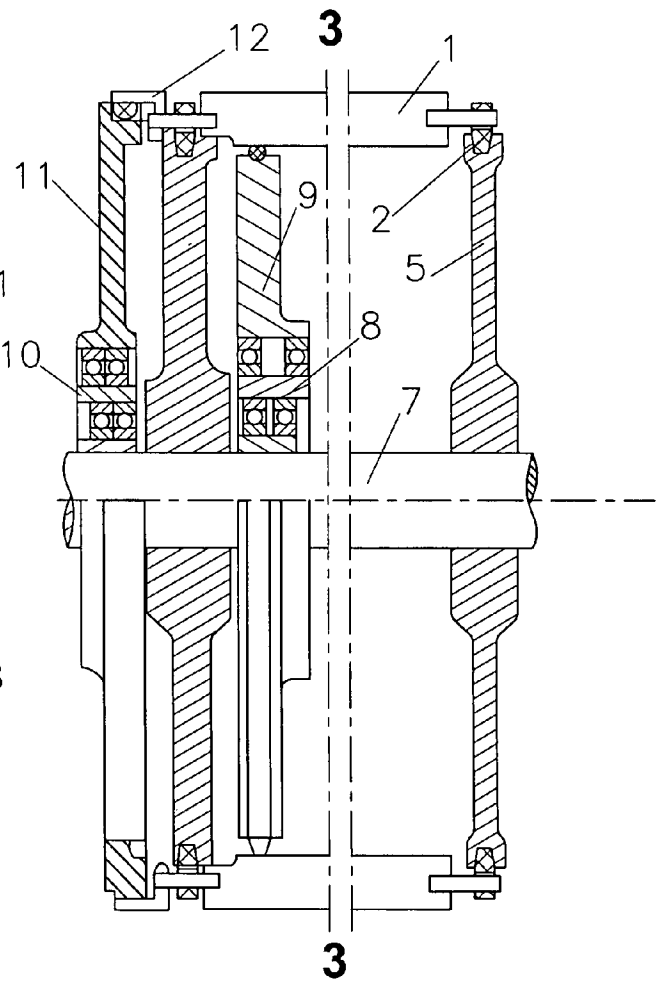
FIG. 3 is a partial schematic section of driving unit of the fan shown in FIG. 1 and indicated with 2-2.
Figure 4:
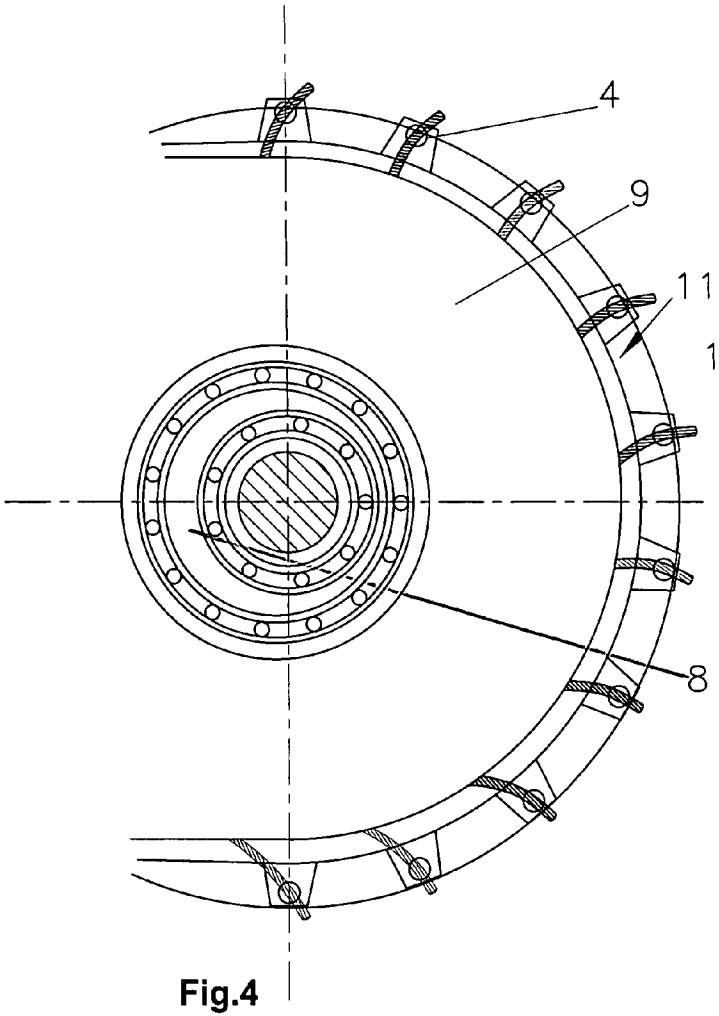
FIG. 4 is a lateral section of the unit shown in FIG. 3 and indicated with 3-3.

The fan, according to the invention, includes two endless belt transmissions 2 supporting blades 1 (FIG. 1 and FIG. 2). Said blades have shanks 3 that are placed in holes of reefs 4 of said belts 2 thus providing swivel fixation of the blades. The said belts encircle leading 5 and follower 6 pulleys. The shaft 7 of the leading pulley 5 is joined with a motor (not shown in the figure).

The air gets in and out through inlet 13 and outlet 14 of frame 15.

Eccentric socket 8 is attached to the shaft 7 of pulley 5 by means of a bearing. The second bearing bears center of directive disc 9. Since one bearing is eccentric with respect to the other, the directive disc 9 is effectively eccentric with respect to the shaft 7. Eccentric socket 10 is similarly attached to the shaft 7 providing eccentricity of directive disc 11. Arms 12 installed on the shanks 3 are adjacent to the disc 11.

When the blades pass leading pulley 5, directive disc 11 presses on arms 12 of blades 1 due to eccentricity of the disc's position, and the blades 1 begin to veer. The further veer continues as the directive disc 9 presses on edges of blades 1. As a result, when the blades move with backward branch of the transmission, position of the blades with respect to the belt, gets changed to coincide with direction of incoming flow.

Another effect of the blades 1 mechanically contacting the directive disc 9 is rotation of the latter disc on the second bearing. A similar action occurs when the blades 1 pass follower pulley 6.

Applying different flexible transmissions (chains, for example) instead of the belts does not depart from scope and spirit of the invention. In general, the fan can be set vertically.

We claim:

1. The linear fan comprising plurality of blades pivotally connected with two endless belts, both supported by two pulleys with their shafts bearing eccentric sockets which, in turn, bear rotating directive discs that mechanically contact the blades' edges providing veer of the blades and, at the same time, enabling rotation of the said discs.

* * * * *